US006773549B1

(12) United States Patent
Burkhardt

(10) Patent No.: US 6,773,549 B1
(45) Date of Patent: Aug. 10, 2004

(54) METHOD FOR PRODUCING AN ENAMELED, OPTICALLY BRIGHTENED PRINTING PAPER

(75) Inventor: Hubertus Burkhardt, Hagen (DE)

(73) Assignee: Stora Enso Publication Paper GmbH & Co., KG, Düsseldorf (DE)

( * ) Notice: Subject to any disclaimer, the term of this patent is extended or adjusted under 35 U.S.C. 154(b) by 0 days.

(21) Appl. No.: 10/070,839

(22) PCT Filed: Sep. 19, 2000

(86) PCT No.: PCT/EP00/09140

§ 371 (c)(1),
(2), (4) Date: Mar. 11, 2002

(87) PCT Pub. No.: WO01/21891

PCT Pub. Date: Mar. 29, 2001

(30) Foreign Application Priority Data

Sep. 23, 1999 (DE) ..... 199 45 580

(51) Int. Cl.[7] ..... D21F 13/00; D21H 19/00

(52) U.S. Cl. ..... 162/137; 162/135; 162/136; 162/162; 427/157; 427/158; 524/522; 524/523

(58) Field of Search ..... 162/137, 135, 162/136, 162; 427/157, 158; 524/522, 523

(56) References Cited

U.S. PATENT DOCUMENTS 4,717,502 A 1/1988 Schmid
5,064,570 A 11/1991 Rohringer
5,846,382 A 12/1998 Von Raven

FOREIGN PATENT DOCUMENTS

| | | |
|---|---|---|
| EP | 0 280 332 | 8/1988 |
| EP | 0 409 028 | 1/1991 |
| EP | 0 624 687 | 11/1994 |
| EP | 0 712 960 | 5/1996 |
| WO | WO 90/01581 | 2/1990 |

OTHER PUBLICATIONS

Technical Association of the Pulp and Paper Industry; Tappi Monograph Series No. 37, Synthetic Binders in Paper Coatings, p. 55, 1975.

*Primary Examiner*—Peter Chin
*Assistant Examiner*—Mark Halpern
(74) *Attorney, Agent, or Firm*—Cohen, Pontani, Lieberman & Pavane

(57) ABSTRACT

A coated, optically brightened printing paper includes a coating base paper and an applied coating containing a pigment, a binder, and color coating supplements, with an optical brightener containing a derivative of diaminostilbene disulfonic acid applied to the outer side of the color coating. The coating base paper is coated with the coating layer using rollers, nozzles, blades, or scrapers, and then dried using IR radiators, hot air, or cylinder contact. An optical solution containing the optical brightener is applied to the dried coating layer and optionally dried again.

9 Claims, No Drawings

METHOD FOR PRODUCING AN ENAMELED, OPTICALLY BRIGHTENED PRINTING PAPER

PRIORITY CLAIM

This is a U.S. national stage of application No. PCT/EP00/09140, filed on Sep. 19, 2000. Priority is claimed on that application and on the following application: Country: Germany, Application No. 199 45 580.5, Filed: 23 September 1999.

BACKGROUND OF THE INVENTION

1. Field of the Invention

The invention relates to a coated, optically brightened printing paper and to a process for its production.

2. Description of the Related Arts

Coated, optically brightened printing papers are known per se and find manifold use in higher-quality printed products, such as illustrated books, brochures and company reports. Optical brighteners are likewise known. In addition to their main field of use in the detergent industry, they have also already been used for decades in the paper industry in order to increase the brightness of the paper produced. Viewed chemically, optical brighteners are derivatives of diaminostilbene disulfonic acid. Their effect is based on the absorption of UV light in a wavelength range from 300–400 nm and emission in a blue range of visible light in the range from 400–450 nm. This leads to a shift in the yellow cast of fibers and fillers into the blue-white range and ultimately to an increase in the spectral reflectance.

The use of optical brighteners during paper making can be carried out in various ways. During the production of coated printing papers, it can be added into the fibers stock suspension upstream of the flow box of the paper machine. If the paper machine has a size press, as it is known, for the surface treatment of the paper, the optical brightener can for example be metered into the starch solution used there. A third possibility is to meter the optical brightener into a coating color which is applied to the coating base paper inside or outside the paper machine or is possibly applied to an already pre-coated coating base paper.

In Wochenblatt für Papierfabrikation No. 15, pp. 529–534 (1983), a report is given on the size-press application of optical brighteners together with a starch suspension. It has also already been proposed to divide the amount of optical brightener to base paper, size press and coating, see PTS-Vortragsband 02/91, pp. 172–175, 15$^{th}$ Coating Symposium 1991.

A device for applying size suspensions, in addition to the known size press, is disclosed by DE-A-34 17 487, which corresponds to U.S. Pat. No. 4,848,268, where a paper web guided around a roll is treated on the front side with coating color and on the rear side with liquid media.

EP-A-0 373 276 describes a process and an apparatus for the continuous spraying of additives onto a moving paper web.

Coated, optically brightened papers produced in accordance with the prior art exhibit certain disadvantages. If the optical brightener is added to the fibers stock suspension upstream of the flow box or is applied to the surface of the coating base paper by means of a size press, then attenuation of the UV light and of the reflected blue light occurs as a result of the coating layer subsequently applied, so that the action of the optical brightener occurs only to an inadequate extent. Increasing the amount of additive is ruled out for cost reasons. Adding the optical brightener into the coating color to be applied is certainly possible in principle, but requires the addition of carrier substances, as they arm known, since the optical brightener itself does not adhere to the pigments of the coating color and therefore, to some extent, is absorbed into the base paper together with the water from the coating color. This problem was solved by the addition of carrier substances, as they are known. These are, for example, starches CMC and polyvinyl alcohol. Because of their anionic charge, they are capable of holding the cationically charged optical brighteners in the applied layer of coating color and bringing them into action under the influence of light.

However, the drawback with using carrier substances is their relatively high inherent viscosity in aqueous solution, which is added to the already relatively high viscosity of the coating color used.

This leads to viscosity problems when processing at high operating speeds in blade coating machines, said problems either limiting the operating speed, leading to non-uniform coating application or making it necessary to dilute the coating color, which in turn entails problems with the drying capacity of the drying equipment arranged downstream.

SUMMARY OF THE INVENTION

The object of the present invention is to provide a coated, optically brightened printing paper and a process for its production which overcomes the problems listed above.

In order to solve the problem, an optically brightened printing paper coated on one or both sides and coated once or many times is proposed, which comprises a coating base paper and a coating layer applied thereto and comprising pigment, binder and coating color aids, which is characterized in that the optical brightener is arranged on the outer side of a coating layer.

Printing paper coated on one side is understood to mean those papas which are provided only for single-sided printing. These include, for example, label papers for bottles and can wrappers. In the same sense, printing pap coated on both sides are printed on both sides. These include, for example, magazine papers, as they are known, for illustrated magazines or catalogues, but also art papers. High-value printed products require the highest surface quality of the side to be printed. This can no longer be achieved with a single coat, as it is known. For this reason, the coating base paper is firstly coated with one or two pre-coats, as they are known, and the top coat, as it is known, is arranged on them.

The pigments considered for the coating layer are all familiar coating pigments, such kaolin, calcium carbonate, talc, titanium dioxide, gypsum, etc.

The binders considered for the coating layer are likewise all familiar coating color binders, such as starch, protein, casein, synthetic lattices etc. Likewise, the coating layer contains conventional coating color aids, such as defoamer, deaerator, lubricant and viscosity regulator. Pigments, binders and coating color aids are familiar to those skilled in the art and active in this field.

The arrangement of the optical brightener on the outer side of the coating layer states that said it is arranged both on the outer side of the coating layer and in the outer layer under the outer side. The porosity of the coating layer, which is always present, if appropriate even after a preceding calendering operation brings about this arrangement with the advantageous effect that the UV proportion of the light strikes the optical brightener without or only with slight attenuation and is emitted as visible blue light in the range from 400–450 nm without or with only slight attenuation as result of which the yellow cast of the fibers and pigments is shifted into the blue-white range. This ultimately leads to an increase in the spectral reflectance and to an improvement in the paper quality. With this arrangement of the optical brightener, a reduction in the amount of brightener is also possible, because of the improved efficiency, so that a reduction in costs is possible.

In a preferred embodiment of the optically brightened printing paper, the optical brightener is arranged on the outer side of the top coat of a coating layer consisting of one or more pre-coats and a top coat. This embodiment has the advantage that no excessively high demands have to be made on the brightness quality of the pre-coat pigments, since the lower brightness of these pigments is compensated for by the whitening effect on the outer layer of the top coat. A reduction in costs is therefore possible.

In a further embodiment of the optically brightened printing paper, the optical brightener is arranged on the outer side of a first coating layer and a further coating layer without an optical brightener is arranged over that. It is known that optical brighteners are destroyed by the continuous action of UV light, and the paper grays. On the other hand, however, in specific applications of the optically brightened printing paper it is not possible to avoid said paper being continually exposed to light. This occurs, for example, in the case of illuminated advertising placards. In this case, the optical brightener arranged on a first coating layer is protected against too much UV light by the further coating layer arranged above it without losing its whitening action.

A process according to the invention for producing an optically brightened printing paper coated on one or both sides and coated once or many times is characterized by the combination of the following features:

A coating base paper, containing chemical pulp and/or groundwood pulp and/or recycled fibers and/or fillers is coated with a coating color, containing white pigments, binders and coating color aids, in a manner known per se by means of roll, nozzle, roll doctor or blade doctor application. The coating applied is dried immediately thereafter by means of infrared radiators, hot air or cylinder contact. Here, a combination of the various drying systems with one another is also possible. An aqueous solution of a derivative of the diaminostilbene disulfonic acid is then applied to the dried top side of the coating layer and, if necessary, dried again.

In order to apply the aqueous solution, roll application devices known per se can be used. A further tried and tested application technique consists in a nozzle application of the aqueous solution. Nozzle applicators of this type are familiar to those skilled in the art.

A preferred embodiment of the process consists in the application of the aqueous solution being performed by means of a roll or nozzle moistener, as it is known, on one or both sides of the coated paper web, the solution or the derivative of the diaminostilbene disulfonic acid being added to the dampening water. This embodiment is recommended in particular when a moisture correction must be carried out on the coated paper web.

The application of the aqueous solution of the derivative of the diaminostilbene disulfonic acid can be carried out in the coating machine arranged directly downstream of the paper machine or in a separately operated coating machine. However, it is also possible to apply the aqueous solution to the calendered coating layer in a rewetting device arranged downstream of a calender, the solution of the derivative of the diaminostilbene disulfonic acid being added to the dampening water.

If the binder contained in the coating layer has carrier properties, such as starch, polyvinyl alcohol or CMC, then a purely aqueous solution of the derivative of the diaminostilbene disulfonic acid can be used for the application. However, if these carrier properties are lacking in the coating layer, then the aqueous solution has a water-soluble carrier, such as starch, CMC or polyvinyl alcohol, added to it. The required amount of optical brightener and, if appropriate, carrier can easily de determined themselves by those skilled in the art. An aqueous solution of 10% by weight of optical brightener (commercially available material) and 3% dissolved starch has been tried and tested.

EXAMPLE

A woody, pre-mated paper was provided with an additional top coat with an applied weight of 8 g/m$^2$. Pre-coat and lop coat contained no optical brightener. The brightness of the coated paper was 75.2%. A 10% aqueous solution of an optical brightener was then applied to the top coat and dried. The absolute dry applied quantity of optical brightener was 0.32 g/m$^2$ commercially available product in this case. The brightness was increased to 97.1%.

What is claimed is:

1. A method for producing an optically brightened printing paper, said method comprising providing a base paper containing at least one of chemical pulp, ground wood pulp, recycled fibers, and fillers, coating said base paper with a color coating layer containing white pigments and binders, drying said color coating layer by means of one of IR radiators, hot air, or cylinder contact, applying an aqueous solution of a derivative of diaminostilbene disulfonic acid to the dried color coating layer, and drying said aqueous solution.

2. A method as in claim 1 wherein said aqueous solution is applied by means of a roll.

3. A method as in claim 2 wherein said aqueous solution is applied by means of a roll dampener which applies dampening water, said aqueous solution of the derivative of diaminostilbene disulfonic acid being added to the dampening water.

4. A method as in claim 1 wherein said aqueous solution is sprayed on using a nozzle.

5. A method as in claim 4 wherein said aqueous solution is applied by means of a nozzle dampener which applies dampening water, said aqueous solution of the derivative of diaminostilbene disulfonic acid being added to the dampening water.

6. A method as in claim 1 wherein said aqueous solution is applied in a coating machine.

7. A method as in claim 1 wherein said aqueous solution, together dampening water, is applied in a rewetting device arranged downstream of a calender.

8. A method as in claim 1 wherein said aqueous solution consists essentially of water and said derivative of diaminostilbene disulfonic acid.

9. A method as in claim 8 wherein said aqueous solution contains about 10% diaminostilbene disulfonic acid.

* * * * *